US007175037B2

(12) United States Patent
Deir

(10) Patent No.: US 7,175,037 B2
(45) Date of Patent: Feb. 13, 2007

(54) SEGREGATED CONTAINER FOR HOLDING MULTIPLE SUBSTANCES

(76) Inventor: Jabra Deir, 6986 Heisley Rd., Mentor, OH (US) 44060

( * ) Notice: Subject to any disclaimer, the term of this patent is extended or adjusted under 35 U.S.C. 154(b) by 44 days.

(21) Appl. No.: 10/779,512

(22) Filed: Feb. 13, 2004

(65) Prior Publication Data

US 2005/0178739 A1 Aug. 18, 2005

(51) Int. Cl.
*B65D 1/04* (2006.01)
*B65D 23/04* (2006.01)

(52) U.S. Cl. ..... 215/10; 215/6; 206/519; 220/23.83

(58) Field of Classification Search ..... 215/6, 215/10, 11.1, DIG. 8, 43; 206/519, 499; 220/23.83
See application file for complete search history.

(56) References Cited

U.S. PATENT DOCUMENTS

| | | | | |
|---|---|---|---|---|
| 295,716 | A | 3/1884 | Baiker | |
| 1,657,927 | A | 1/1928 | Heinzen | |
| 1,918,308 | A * | 7/1933 | Webber | 215/6 |
| 2,661,870 | A | 12/1953 | Huenergardt | |
| 2,938,518 | A * | 5/1960 | Horrocks | 604/403 |
| 3,459,295 | A | 8/1969 | Cousar | |
| 3,613,955 | A * | 10/1971 | Wetherell, Jr. | 222/83 |
| 4,776,972 | A * | 10/1988 | Barrett | 252/186.38 |
| 5,114,011 | A * | 5/1992 | Robbins, III | 206/499 |
| 5,384,138 | A * | 1/1995 | Robbins et al. | 426/111 |
| 5,439,103 | A * | 8/1995 | Howes | 206/217 |
| 5,749,460 | A * | 5/1998 | Rice | 220/23.83 |
| 5,806,707 | A * | 9/1998 | Boehm et al. | 220/522 |
| 5,836,479 | A * | 11/1998 | Klima et al. | 222/83.5 |
| 5,950,689 | A | 9/1999 | Varlet | |
| 6,059,443 | A * | 5/2000 | Casey | 366/130 |
| 6,085,927 | A * | 7/2000 | Kusz | 220/23.87 |
| 6,180,149 | B1 * | 1/2001 | Gramm | 426/394 |
| 6,375,041 | B1 * | 4/2002 | Klima et al. | 222/129 |
| 6,644,471 | B1 * | 11/2003 | Anderson | 206/222 |

* cited by examiner

*Primary Examiner*—Sue A. Weaver
(74) *Attorney, Agent, or Firm*—Rankin, Hill, Porter & Clark LLP

(57) ABSTRACT

A segregated container for holding multiple substances including an outer container, and inner container, a sealing member, and a sealing cap. The inner container is at least partially slidably received within the outer container. The sealing member is releasably secured to an upper rim of the inner container so as to define a closed space within the inner container. The sealing cap is sealingly secured to the outer container circular rim so as to secure the inner container within the outer container. The inner and outer containers may each contain a substance, solid or liquid, that is isolated from the other during shipment and storage, and which may be separately accessed for use.

1 Claim, 2 Drawing Sheets

SEGREGATED CONTAINER FOR HOLDING MULTIPLE SUBSTANCES

BACKGROUND OF THE INVENTION

1. Field of the Invention

The present invention generally relates to containers and, more particularly, toward containers having plural segregated compartments.

2. Description of Related Art

Containers having segregated compartments are known in the art. Such containers include those having an inner container and an outer container, wherein the inner container has a rim that rests on the mouth of the outer container.

For example, U.S. Pat. No. 5,950,689 teaches a baby bottle assembly having an outer bottle, an inner bottle, and a sealing assembly. The outer bottle includes an open mouth, and the inner bottle has a flange or rim that rests on the open mouth of the outer bottle. The sealing assembly includes a nipple base that is compressed between a sealing nut and the outer bottle mouth and the inner bottle rim. In use, the nipple and sealing nut are removed from the outer bottle, the inner bottle is taken out of the outer bottle and the contents of the inner bottle is poured into the outer bottle. Thereafter, the nipple and sealing nut are reinstalled on the outer bottle.

U.S. Pat. No. 6,059,443 teaches a method for mixing and storing two substances in a container, wherein the container includes an outer bottle and an inner bottle that are affixed to one another by means of a plurality of support arms. The arms extend between a lip of the outer bottle and the lip or rim of the inner bottle. Hence, the inner bottle is affixed to the outer bottle and cannot be removed therefrom. The construction of the '443 bottle permits shipping of two different materials in the outer bottle, and subsequent mixture of the materials within the outer bottle following removal of a seal.

U.S. Pat. No. 3,459,295 teaches another container having a pair of segregated compartments. A cap seals the individual compartments. It is noted that the compartments cooperate to define a unitary structure insofar as the inner compartment is not removable from the container.

There exists a need in the art for a method and device for shipping different substances in a single container, wherein the different substances may be separately accessed by the user. There further exists a need in the art for a method and device whereby dray substances may be shipped in a container holding a liquid, without being damaged or moistened by the liquid.

SUMMARY OF THE INVENTION

The present invention is directed toward a segregated container for holding multiple substances including an outer container, and inner container, a sealing member, and a sealing cap. The inner container is at least partially slidably received within the outer container. The sealing member is releasably secured to an upper rim of the inner container so as to define a closed space within the inner container. The sealing cap is sealingly secured to the outer container circular rim so as to secure the inner container within the outer container. The inner and outer containers may each contain a substance, solid or liquid, that is isolated from the other during shipment and storage, and which may be separately accessed for use.

In accordance with one embodiment of the present invention, the inner container rim extends laterally from a body of the inner container and rests upon a circular rim of the outer container. The circular rim of the outer container, in a second embodiment, has an annular recess that receives the inner container rim.

In accordance with a third embodiment of the present invention, the inner container rim is coextensive with the inner container body, and the sealing member supports the inner container on the outer container.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
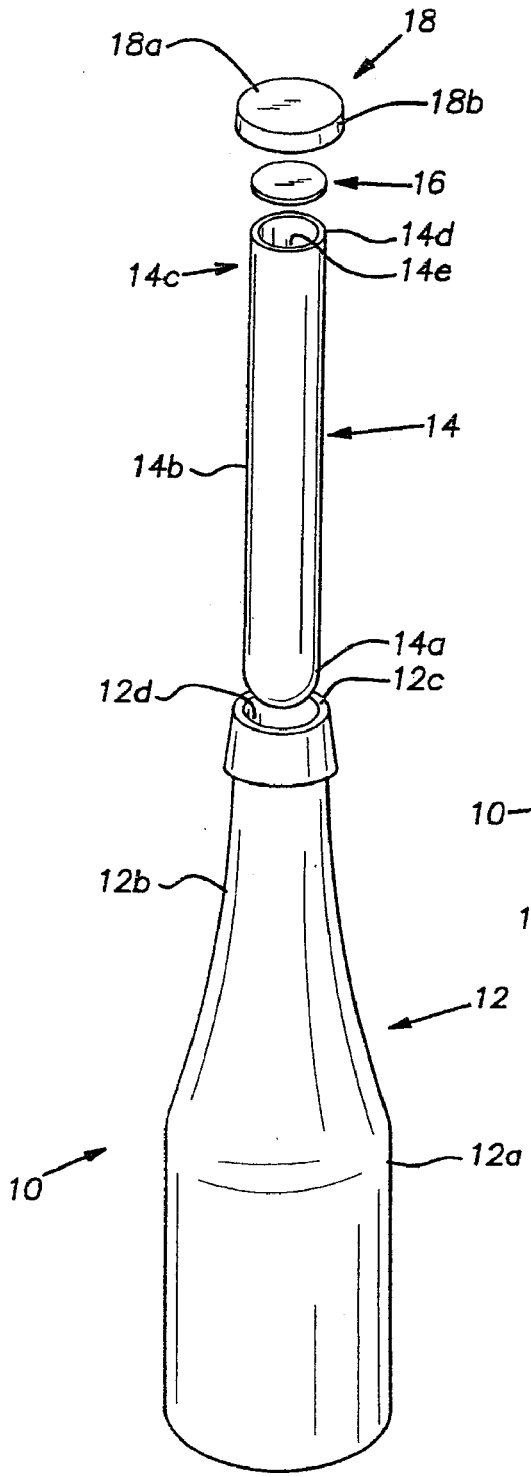
FIG. 1 is an exploded perspective view of the assembly according to the present invention.
Figure 2:
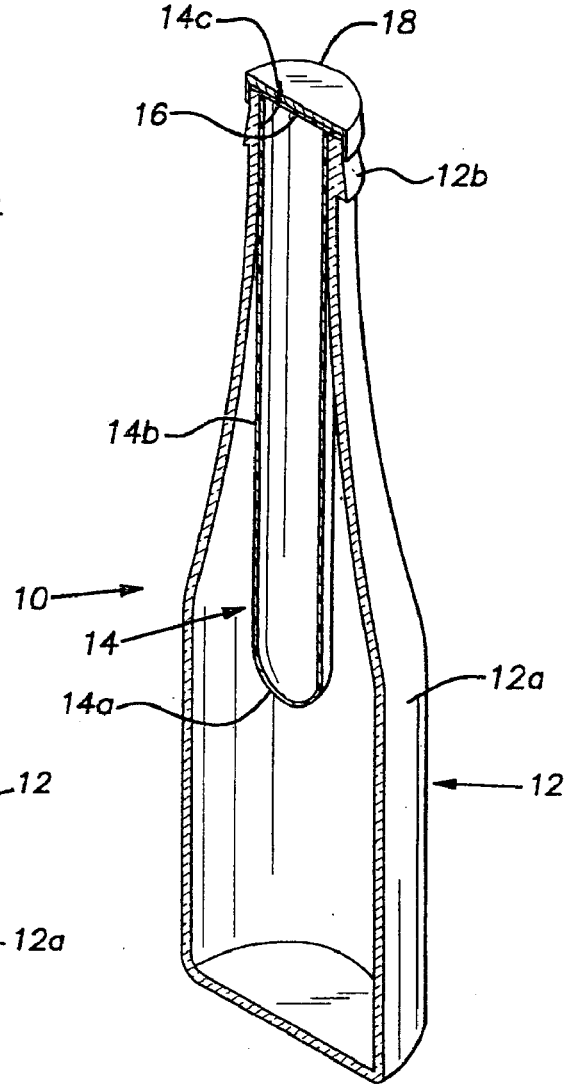
FIG. 2 is a cross sectional view of the assembly according to the present invention.

With reference to the drawings, the present invention is directed toward a container assembly 10 including an outer container 12, an inner container 14, a sealing member 16, and a sealing cap 18. The outer container 12 is preferably a conventional bottle such as is well known in the art and readily commercially available. Accordingly, the outer container 12 may be formed from glass, plastic, or any other suitable material. For example, should the outer container hold a consumable beverage, such as water, soda, beer, etc., the outer container will be formed from an appropriate material, such as glass or HDPE. On the other hand, should the outer container 12 hold a non-consumable liquid or granular substance, the outer container 12 may be formed from another conventional material that is suitable for use in conjunction with that particular liquid or substance.

The outer container 12 is generally elongated, and preferably has a flat bottom surface, a somewhat cylindrical sidewall 12*a*, and a neck region 12*b* including a circular rim 12*c* that surrounds the outer container opening 12*d*. An upper end portion of the neck region 12*b* may have external threads, as is known in the art, to threadably receive a threaded cap (i.e., cap member 18). Alternatively, the upper end of the neck region 12*b* may be free of threads so as to receive a push-on cap (i.e., cap member 18).

In the preferred embodiment, the inner container 14 is preferably elongated so as to have a test tube-like shape, as illustrated. As such, the inner container 14 has a closed bottom end 14*a*, a generally cylindrical sidewall 14*b*, and an upper end 14*c*. The upper end 14*c* has a circular rim 14*d* that surrounds the opening 14*e* formed in the inner container. The rim 14*d* may be slightly enlarged so as to protrude laterally from the cylindrical sidewall 14*b*, as shown best in FIGS. 3A–3B. Alternatively, the circular rim 14*d* may have a diameter that is equal to the diameter of the cylindrical sidewall 14*b* so as to be generally coextensive with the cylindrical sidewall 14*b*, as shown best in FIG. 3C.

The inner container 14 will be formed from a material that is compatible with both the substance held within the inner container 14 and the substance held within the outer container 12. For example, should both containers both 12, 14 hold consumable beverages, the inner container 14 will be formed from a material that is compatible with such consumable beverages, such as glass and HDPE.

The sealing member 16 is releasably secured to the circular rim 14*d* of the inner container 14 so as to seal the interior of the inner container 14. The sealing member 16 cooperates with the inner container 14 so as to define a closed or isolated space within the inner container 14. The sealing member 16 is a membrane that is formed from a plastic sheet, metal foil, or another suitable material, and is releasably secured to the circular rim 14*d* by known means. For example, a thin film of adhesive between the circular rim 14*d* of the inner container 14 and the sealing member 16 may be used to releasably, yet sealingly, secure the sealing member 16 to the inner container rim 14*d*. It is believed that, due to the minimal thickness of the sealing member 16, that the sealing member will not interfere with the sealing of the cap member 18 to the outer container 12. Accordingly, while it may be preferred that the sealing member 16 be essentially coextensive with the inner container rim 14*d*, the sealing member 16 may, instead, extend outwardly from the inner container rim 14*d* and at least partially cover the outer container rim 12*c*, as will be apparent from the following.

The sealing cap 18 has a generally circular body 18*a* from which a cylindrical edge 18*b* downwardly extends. The cylindrical edge 18*b* may include interior threads to facilitate threaded securement to mating threads on the outer container neck region 12*b*, as described previously. Alternatively, the cylindrical edge 18*b* may be sealingly pushed onto the neck region 12*b* and over the circular rim 12*c* of the outer container 12. The sealing cap 18 may be formed from metal, plastic, or a combination of metal and plastic, as is well known in the art. As will be apparent to those skilled in the art, the aforementioned sealing cap 18 is generally conventional and well known in the art.

When assembled, the inner container 14 is received within the outer container 12, the sealing member 16 is sealingly secured to the circular rim 14*d* of the inner container 14, and the sealing cap 18 is sealingly disposed over the circular rim 12*c* of the outer container 12. In accordance with the present invention, the particular configuration of the inner container rim 14*d* relative to the outer container rim 12*c* and the sealing member 16/sealing cap 18 may take several different forms.

Figure 3A:
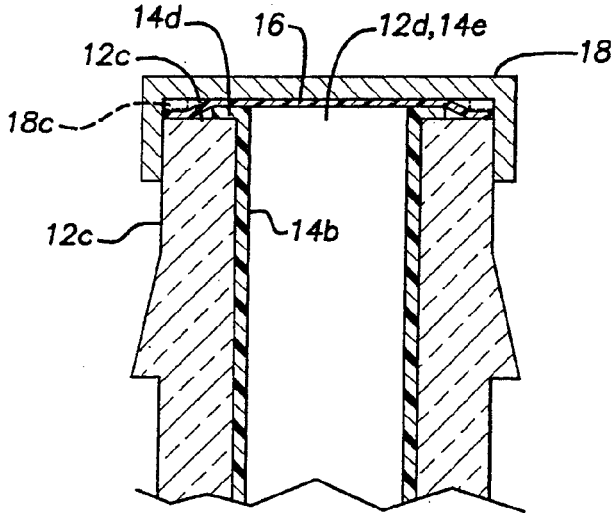
FIG. 3A is an enlarged cross-sectional view of a first embodiment of the present invention.

In accordance with a first embodiment, which is illustrated in FIG. 3A, the inner container cylindrical sidewall 14*b* is slightly smaller than the opening 12*d* in the outer container 12 while the inner container rim 14*d* is slightly larger than the opening 12*d* formed in the outer container 12. Accordingly, the inner container 14 is slidingly received within the outer container 12 while the inner container rim 14*d* rests upon the outer container rim 12*c*.

Further, the sealing member 16 is releasably sealed to the inner container rim 14*d* and extends outwardly therefrom. In this regard it is noted that the sealing member 16 may be contiguous with the inner container rim 14*d*, so the illustrated radial extension of the sealing member from the inner container rim 14*d* may be considered to be optional. The sealing cap 18 may engage the sealing member 16 or may be spaced slightly therefrom. Alternatively, the sealing cap 18 may have an annular rib 18*c* (shown in dashed lines) to facilitate sealing engagement with the circular rim 12*c* of the outer container 12, either directly or via the sealing member 16 should the sealing member 16 be interposed between the cap 18 and rim 12*c*.

Figure 3B:
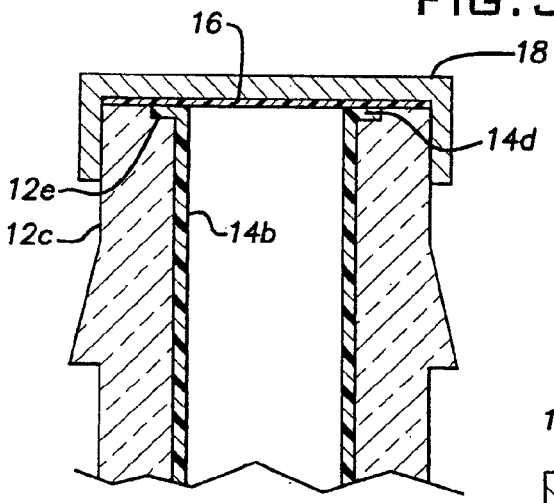
FIG. 3B is an enlarged cross-sectional view of a second embodiment of the present invention; and, FIG. 3C is an enlarged cross-sectional view of a third embodiment of the present invention.

In accordance with a second embodiment of the present invention, which is shown in FIG. 3B, the radially inner portion of the outer container rim 12*c* has a stepped annular recess 12*e*. The rim 14*d* of the inner container 14 is received in the recess 12*c* such that the upper surfaces of the inner container rim 14*c* and the outer container rim 12*c* are substantially flush or coplanar. The sealing member 16 extends radially from the inner container rim 14*d* so as to overlie the outer container rim 12*c*. Alternatively, the sealing member 16 may be substantially coextensive with the inner container rim 14*d*. The sealing cap 18 is secured to the outer container in a conventional manner.

Figure 3C:
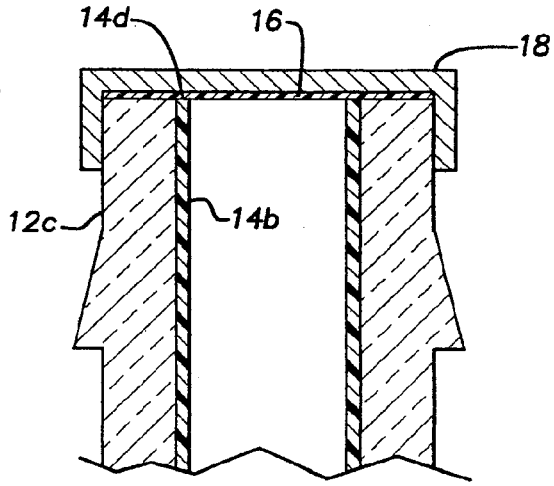

In accordance with a third embodiment of the present invention, which is illustrated in FIG. 3C, the inner container 14 does not include a rim that extends radially from the container sidewall. Rather, the rim 14*d* is coextensive with the inner container sidewall 14*b*. As such, the inner container is received within the outer container 12 and the sealing member is disposed on the outer container rim 12*c* and serves to support the inner container 14 within the outer container 12. Alternatively, the inner container 14 may include a radially extending rim such as shown in FIGS. 3A–3B wherein the radially extending rim has an outer diameter that is slightly smaller than the opening 12*d* in the outer container such that the inner container, including the rim, may be slidably received within the outer container 12.

Although the inner container 14 described and illustrated herein has a generally circular cross-sectional shape, it is considered apparent that the inner container 14 may have a different cross-sectional shape, such as rectangular, square, triangular, etc.

The present invention is believed to be useful in storing and dispensing many different substances. The inner and outer containers may each hold a beverage that may be either consumed separately or combined in a complimentary fashion. For example, the outer container may hold a soft drink, such as juice, water, soda, etc., and the inner container may hold an alcoholic beverage, such as vodka, gin, rum, etc. By adjusting or providing appropriate volumes in each of the inner and outer containers, a uniform, desirable mixed drink will result from mixing the contents of the inner and outer containers, either directly in the outer container or in a separate glass. In a similar fashion, the inner and outer containers may each hold soft drinks (i.e., tea and lemon juice, respectively) or alcoholic drinks (beer and whiskey, respectively).

Further, the outer container may hold a beverage, such as beer or soda, while the inner container holds a solid snack food (peanuts, pretzels, etc.) or a non-food item (cigarette, game card, message containing a fortune or advertisement, etc.).

Still further, it is contemplated that the segregated container of the present invention is useful in storing and dispensing non-food related items. For example, the outer container may hold laundry detergent (powder or liquid) while the inner container holds fabric softener. As such, a single use laundry treatment system may be provided in the container of the present invention, as may be desired in coin operated laundry facilities.

Based upon the foregoing it should be clear that numerous alternative uses for the segregated container of the present invention is contemplated, and the present invention is not to be limited to those examples specifically detailed herein. Rather, it is considered apparent that one skilled in the art, based upon the teachings of the present application, will find uses for the present invention in many different applications.

What is claimed is:

1. A segregated container for holding multiple substances, comprising:

an outer container, said outer container having a circular rim;

an inner container, said inner container being at least partially slidably received within said outer container, said inner container having an elongated shape with an upper rim, a cylindrical sidewall, and a closed bottom end, said upper rim being coextensive with said cylindrical sidewall;

a sealing member, wherein said sealing member is a membrane that is releasably secured to the inner container upper rim so as to cooperate with said inner container to define a closed space within said inner container; and, a sealing cap, said sealing cap being sealingly secured to said outer container circular rim so as to secure said inner container within said outer container wherein said inner container may be entirely slidably received within said outer container, and wherein said sealing member is received on said outer container circular rim and helps to support said inner container on said outer container.

* * * * *